US009351559B2

(12) United States Patent
Pardo et al.

(10) Patent No.: US 9,351,559 B2
(45) Date of Patent: May 31, 2016

(54) POWERED SKIN CARE DEVICE

(71) Applicant: ELC Management LLC, Melville, NY (US)

(72) Inventors: Janet Pardo, New York, NY (US); Lois Ann Cecere, Staten Island, NY (US); Thomas Edward Owen, Montauk, NY (US); Jenny Wong, Metuchen, NJ (US); Chong Won Jessica Woo-Kim, Palisades Park, NJ (US); Richard LaPosta, Ramsey, NJ (US); Jenny Warner Belknap, New York, NY (US); Herbert Fischer, Reitnau (CH)

(73) Assignee: ELC Management LLC, Melville, NY (US)

( * ) Notice: Subject to any disclaimer, the term of this patent is extended or adjusted under 35 U.S.C. 154(b) by 284 days.

(21) Appl. No.: 14/264,853

(22) Filed: Apr. 29, 2014

(65) Prior Publication Data

US 2015/0305486 A1 Oct. 29, 2015

(51) Int. Cl.

| | |
|---|---|
| ***A46B 13/02*** | (2006.01) |
| ***A47K 7/04*** | (2006.01) |
| ***A61H 23/02*** | (2006.01) |
| ***A46B 13/00*** | (2006.01) |
| ***A46B 7/04*** | (2006.01) |
| ***A46B 9/06*** | (2006.01) |

(52) U.S. Cl.

CPC ..... *A46B 13/008* (2013.01); *A46B 7/04* (2013.01); *A46B 9/06* (2013.01); *A46B 13/023* (2013.01); *A47K 7/043* (2013.01); *A61H 23/0263* (2013.01); *A46B 2200/102* (2013.01)

(58) Field of Classification Search

CPC ..... A47K 7/043; A46B 13/02; A46B 13/023; A46B 13/22; A46B 13/1006; A46B 13/102; A61H 23/00; A61H 23/02; A61H 23/0254; A61H 23/0263; A61H 2023/0209

USPC ..... 15/22.1; 601/46, 67, 68, 72, 73, 80, 81

See application file for complete search history.

(56) References Cited

U.S. PATENT DOCUMENTS

| | | | |
|---|---|---|---|
| 1,974,031 | A | 9/1934 | Merrill |
| 2,512,499 | A | 6/1950 | Loosen |
| 2,593,875 | A | 4/1952 | Grunwald |
| 2,985,166 | A | 5/1961 | Burkardt |

(Continued)

FOREIGN PATENT DOCUMENTS

| | | |
|---|---|---|
| CA | 2557314 | 10/2005 |
| CN | 2650589 | 10/2004 |

(Continued)

OTHER PUBLICATIONS

PCT Int'l Search Report; Int'l Application No. PCT/US2015/027922; Completion Date: Jul. 17, 2015; Date of Mailing: Jan. 22, 2015.

(Continued)

*Primary Examiner* — Mark Spisich

(74) *Attorney, Agent, or Firm* — Martin W. Haerter

(57) ABSTRACT

A powered skin care device is provided with a vibrating motor that produces vibrations in a relatively gentle frequency and has a removable brush head that includes at least two types of bristles. A first group of bristles is for more gentle cleansing and a second group of bristles is for more aggressive cleansing.

6 Claims, 5 Drawing Sheets

(56) References Cited

U.S. PATENT DOCUMENTS

| | | | |
|---|---|---|---|
| 3,699,952 | A | 10/1972 | Waters et al. |
| D226,043 | S | 1/1973 | Wolff |
| 3,733,634 | A | 5/1973 | Golbe |
| 3,864,779 | A | 2/1975 | Thomas |
| 3,968,789 | A | 7/1976 | Simoncini |
| 4,027,348 | A | 6/1977 | Flowers et al. |
| D245,883 | S | 9/1977 | Tsuji et al. |
| D245,948 | S | 10/1977 | Wolff |
| D250,228 | S | 11/1978 | Long |
| 4,203,431 | A | 5/1980 | Abura et al. |
| D257,747 | S | 1/1981 | MacGregor |
| D281,035 | S | 10/1985 | Herzfeld |
| 4,799,280 | A | 1/1989 | Lee |
| D305,480 | S | 1/1990 | Yuen |
| 5,471,695 | A | 12/1995 | Aiyar |
| D368,343 | S | 3/1996 | Gebhard et al. |
| D376,694 | S | 12/1996 | Aiyar |
| 5,956,792 | A | 9/1999 | Gutelius et al. |
| D448,852 | S | 10/2001 | Engelen |
| 6,569,170 | B1 | 5/2003 | Kellogg |
| 6,601,591 | B1 | 8/2003 | Carullo et al. |
| 6,652,888 | B2 | 11/2003 | Rhoades |
| D517,811 | S | 3/2006 | Daubenspeck et al. |
| D533,943 | S | 12/2006 | Chen |
| 7,157,816 | B2 | 1/2007 | Pilcher et al. |
| 7,179,152 | B1 | 2/2007 | Rhoades |
| D538,473 | S | 3/2007 | Rhoades |
| D548,843 | S | 8/2007 | Kertz |
| D549,964 | S | 9/2007 | Roth et al. |
| 7,267,673 | B2 | 9/2007 | Pilcher et al. |
| 7,282,037 | B2 | 10/2007 | Cho |
| 7,306,569 | B2 | 12/2007 | LaJoie et al. |
| D559,058 | S | 1/2008 | Radi |
| 7,320,691 | B2 | 1/2008 | Pilcher et al. |
| 7,360,269 | B2 | 4/2008 | Cobabe et al. |
| 7,384,405 | B2 | 6/2008 | Rhoades |
| 7,386,906 | B2 | 6/2008 | Roth et al. |
| D573,346 | S | 7/2008 | Daubenspeck et al. |
| 7,469,703 | B2 | 12/2008 | France et al. |
| 7,481,592 | B2 | 1/2009 | Gueret |
| D589,257 | S | 3/2009 | Van Wambeke |
| 7,572,238 | B2 | 8/2009 | Rhoades |
| D601,803 | S | 10/2009 | Reishus et al. |
| 7,638,144 | B2 | 12/2009 | Rhaodes |
| D612,612 | S | 3/2010 | Harris et al. |
| 7,786,626 | B2 | 8/2010 | Reishus et al. |
| 7,789,092 | B2 | 9/2010 | Akridge et al. |
| 7,832,954 | B2 | 11/2010 | Gueret |
| 7,918,862 | B2 | 4/2011 | Hull, Jr. et al. |
| D639,068 | S | 6/2011 | Cobabe et al. |
| D646,487 | S | 10/2011 | Leppla et al. |
| D652,523 | S | 1/2012 | Bradley et al. |
| 8,360,998 | B2 | 1/2013 | Apodaca et al. |
| 8,425,134 | B2 | 4/2013 | Gueret |
| 8,484,788 | B2 | 7/2013 | Brewer et al. |
| D715,554 | S | 10/2014 | Hosler et al. |
| D715,555 | S | 10/2014 | Hosler et al. |
| D715,556 | S | 10/2014 | Brewer |
| D715,557 | S | 10/2014 | Brewer et al. |
| D715,558 | S | 10/2014 | Brewer |
| 2002/0156402 | A1 | 10/2002 | Woog et al. |
| 2005/0144744 | A1 | 7/2005 | Thiess et al. |
| 2005/0278877 | A1 | 12/2005 | Akridge et al. |
| 2006/0122631 | A1 | 6/2006 | Kertz |
| 2006/0236473 | A1 | 10/2006 | Jaffe |
| 2007/0101522 | A1 | 5/2007 | Alfano |
| 2007/0142845 | A1 | 6/2007 | Akridge et al. |
| 2008/0005860 | A1 | 1/2008 | Niizaki et al. |
| 2008/0097355 | A1 | 4/2008 | Pilcher et al. |
| 2008/0110471 | A1 | 5/2008 | Oliver et al. |
| 2009/0083919 | A1* | 4/2009 | Taggart ..... A46B 5/00 15/22.2 |
| 2009/0124985 | A1 | 5/2009 | Hasenoehrl et al. |
| 2009/0177125 | A1 | 7/2009 | Pilcher et al. |
| 2010/0222719 | A1 | 9/2010 | Cowie et al. |
| 2011/0061186 | A1* | 3/2011 | Questiaux ..... A46B 5/0095 15/22.1 |
| 2012/0121309 | A1 | 5/2012 | Liu |
| 2012/0165710 | A1 | 6/2012 | Nichols |
| 2012/0186029 | A1* | 7/2012 | D'Alleva ..... A46B 5/0095 15/22.1 |
| 2012/0233798 | A1 | 9/2012 | Brewer et al. |
| 2013/0023806 | A1 | 1/2013 | Ungemach et al. |
| 2013/0060176 | A1 | 3/2013 | Nichols |
| 2014/0037364 | A1 | 2/2014 | Hartstock et al. |
| 2014/0058300 | A1* | 2/2014 | Ungemach ..... A61H 7/005 601/136 |

FOREIGN PATENT DOCUMENTS

| | | | |
|---|---|---|---|
| DE | 3615918 | | 11/1987 |
| DE | 19534368 | | 3/1997 |
| FR | 2687055 | | 8/1993 |
| FR | 2928249 | * | 9/2009 |
| JP | 54110055 | | 8/1979 |
| JP | 54110056 | | 8/1979 |
| JP | 3-222905 | * | 10/1991 |
| JP | 8-126786 | * | 5/1996 |
| JP | 2001-70048 | * | 3/2001 |
| JP | 2001-275753 | * | 10/2001 |
| JP | 2008503324 | | 2/2008 |
| WO | WO03/096860 | | 11/2003 |
| WO | WO-2006/002109 | | 1/2006 |
| WO | WO2013/014588 | | 1/2013 |

OTHER PUBLICATIONS

PCT Int'l Search Report; Int'l Application No. PCT/US2015/027933; Completion Date: Jul. 22, 2015; Date of Mailing: Jul. 22, 2015.

PCT Int'l Search Report; Int'l Application No. PCT/US2015/027967; Completion Date: Jul. 17, 2015; Date of Mailing: Jul. 22, 2015.

PCT Written Opin of the Int'l Searching Auth; Int'l Application No. PCT/US2015/027922; Completion Date: Jul. 17, 2015; Mailing Date: Jul. 22, 2015.

PCT Written Opin of the Int'l Searching Auth; Int'l Application No. PCT/US2015/027933; Completion Date: Jul. 22, 2015; Mailing Date: Jul. 22, 2015.

PCT Written Opin of the Int'l Searching Auth; Int'l Application No. PCT/US2015/027967; Completion Date: Jul. 17, 2015; Mailing Date: Jul. 22, 2015.

* cited by examiner

POWERED SKIN CARE DEVICE

BACKGROUND OF THE INVENTION

1. Field of the Invention

The present invention relates to a powered skin care device. In particular, the present invention is directed to a powered skin care brush for gently cleansing skin.

2. Description of the Prior Art

Powered skin cleansing devices having rotating, vibrating or oscillating brushes are known, but may be relatively aggressive when compared to hand washing or washing with a wash cloth. In addition, the devices tend to transmit more vibrations to the hand of the user holding the device than is desirable.

Accordingly, there is a need for a powered skin care device that is more gentle in cleansing skin and transmits less vibration to the hand holding the device.

BRIEF SUMMARY OF THE INVENTION

It is an object of the invention to provide a powered skin care device with a vibration damper, a relatively mild vibration source and relatively soft bristles in a structural arrangement such that the device is gentler in cleansing skin.

It is another object of the invention to provide a powered skin care device with a damper, a relatively mild vibrator source and soft bristles in a structural arrangement such that the device transmits significantly less vibration to the hand holding the device, making the device more comfortable for users.

Accordingly, powered skin care device is provided with a vibration damper between a head supporting platform including a vibrating motor, and a handle of the device. Additionally, the vibrating motor provides vibrations in a relatively gentle frequency and the brush head is provided with relatively soft bristles.

DETAILED DESCRIPTION OF THE INVENTION

Figure 1:
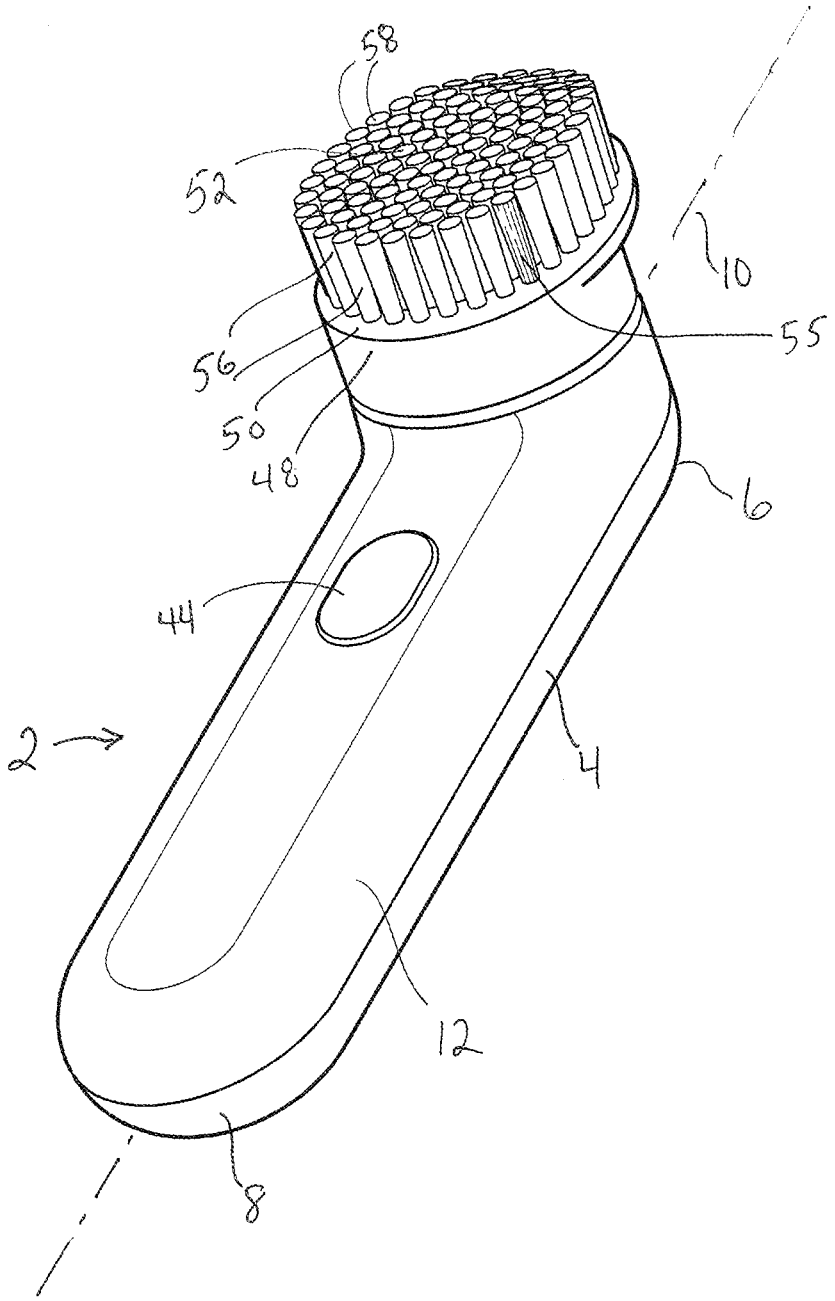
FIG. 1 is a bottom, front and right side perspective view of the powered skin care device of the present invention.
Figure 2:
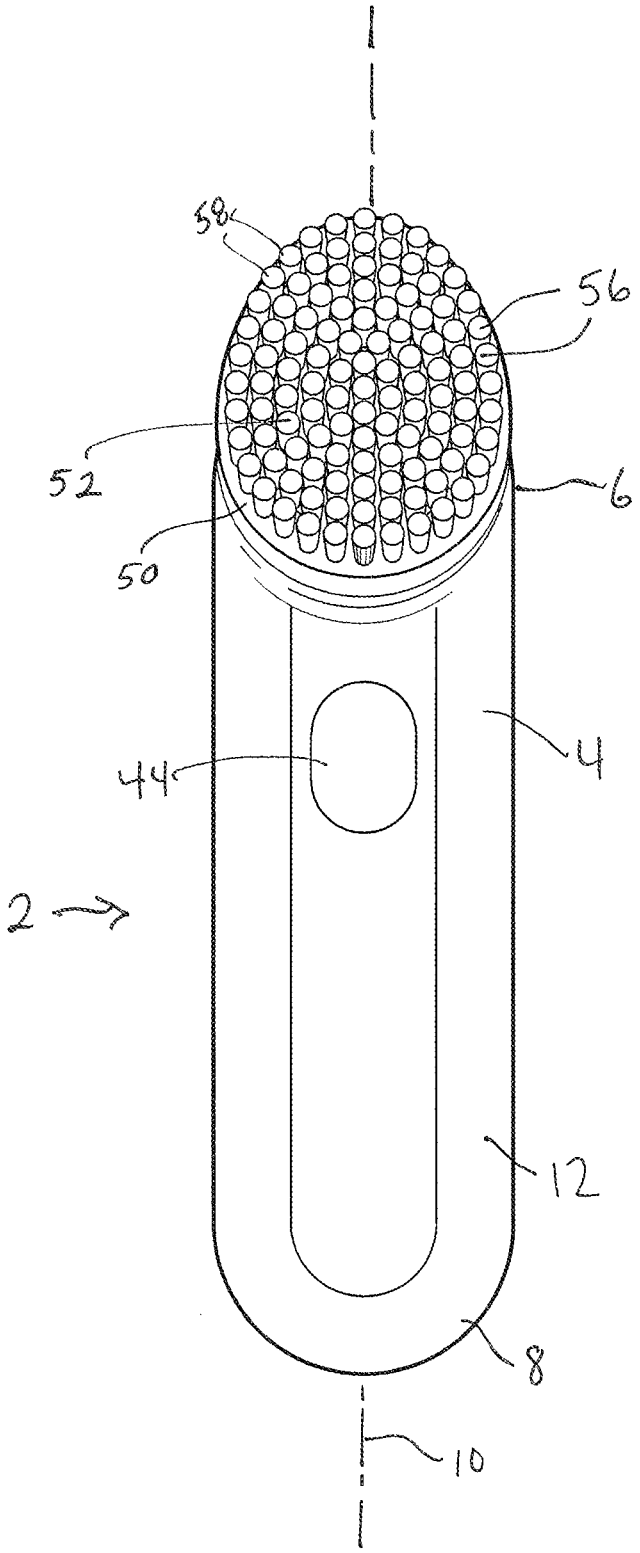
FIG. 2 is a front elevation view of the device of FIG. 1.
Figure 3:
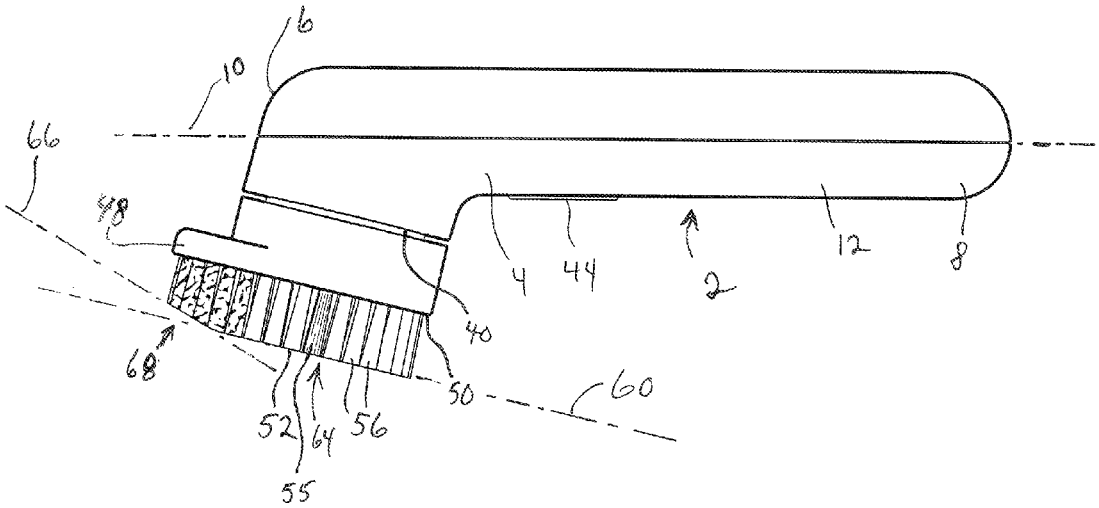
FIG. 3 is a right side elevation view of the device of FIG. 1.
Figure 4:
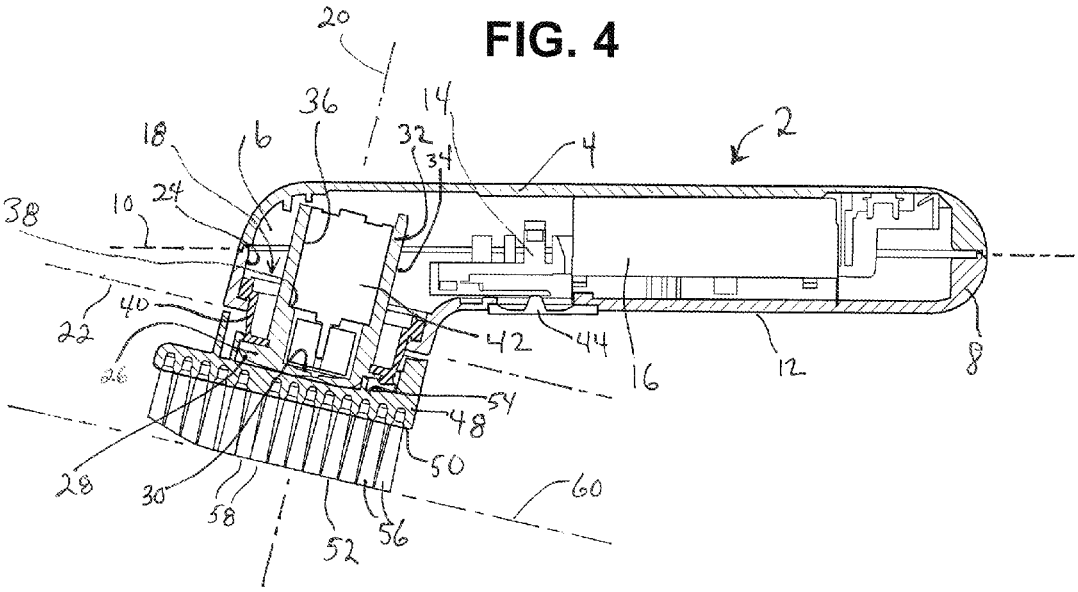
FIG. 4 is a right side sectional view of the device of FIG. 1.
Figure 5:
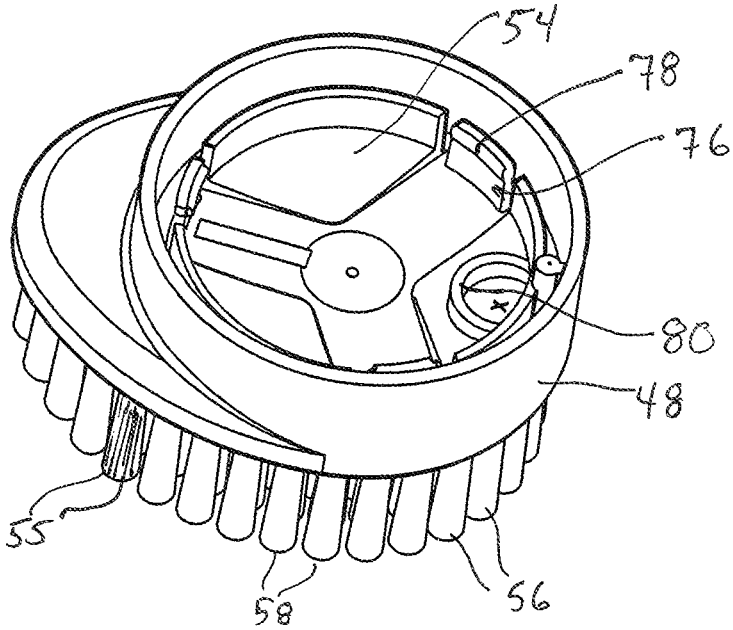
FIG. 5 is a top, rear and right side perspective view of the selectively removable brush head of the device of FIG. 1.
Figure 6:
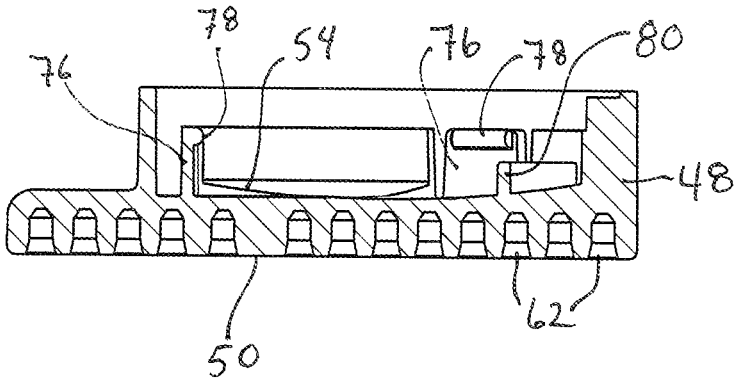
FIG. 6 is a right side sectional view of the brush head of FIG. 5.
Figure 7:
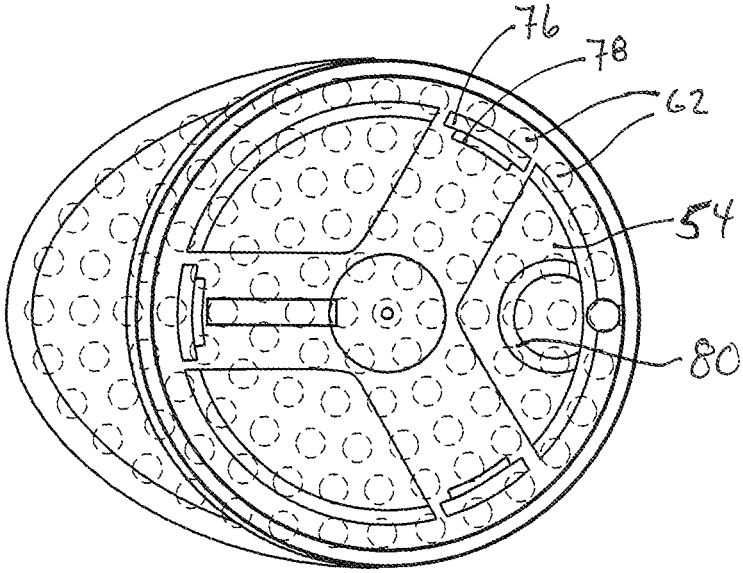
FIG. 7 is a top plan view of the brush head of FIG. 5.
Figure 8:
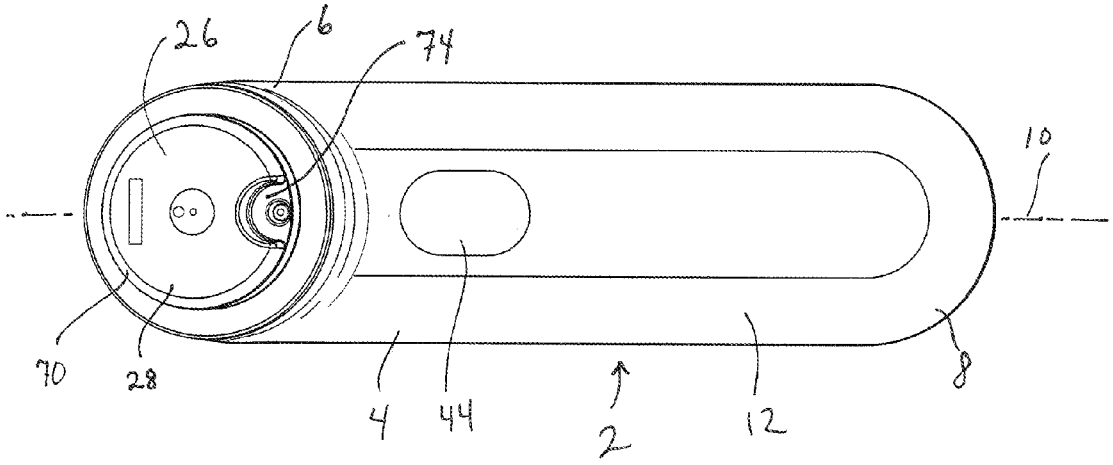
FIG. 8 is a bottom plan view of the powered skin care device of the present invention with the brush head removed.
Figure 9:
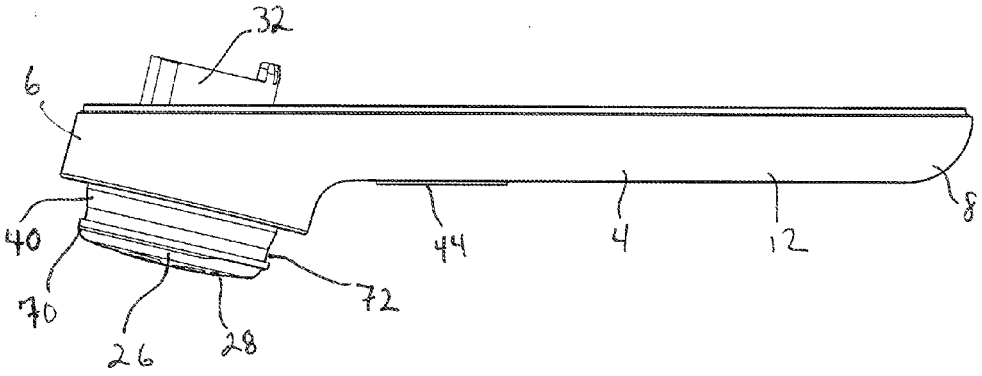
FIG. 9 is a side elevation view of the bottom half of the housing the powered skin care device of the present invention.

Referring now to FIGS. 1-9, a powered skin care device according to the invention is shown generally at reference number 2. The device has a housing 4 with a hollow proximal end 6 and a dosed distal end 8. A longitudinal axis 10 is defined from the proximal end 6 to the distal end 8. The distal end 8 forms a handle 12. The housing 4 encloses an electronic circuit 14 connected to a battery 16 (FIG. 4). The proximal end 6 defines an opening 18 oriented along an oblique angle represented by axis 20 in FIG. 4 (with axis 22 representing the plane in which the opening 18 lies) with respect to the longitudinal axis 10. The opening defines an inwardly directed annular surface 24 (FIG. 4).

A head support platform (see FIGS. 4, 8 and 9) defines an outer bearing surface 28 and an inner surface 30. A skirt 32 depends from the inner surface 30 of the platform 26. The skirt defines an outwardly directed annular surface 34 dimensioned to be received in spaced relation within the opening 18 of the proximal end 6 of the housing 4. The skirt further defines a cavity 36. At least one drive support structure 38 is located on the skirt 32 or on the inner surface 30 of the platform within the cavity 36. In the embodiment shown, the drive support structure 38 is a shoulder inside the skirt 32.

A vibration damper 40 is provided in the form of a resilient collar made from an elastically compliant material. The damper 40 connects the inwardly directed annular surface 24 of the opening 18 in the housing 4 to the outwardly directed annular surface 34 of the platform 26. The damper 40 resiliently secures the skirt 32 in the opening 18 of the hollow proximal end 6 of the housing 4 such that the outer bearing surface 28 of the platform is positioned outside of the opening 18. The damper 40 acts to reduce the transmission of vibrations from the platform 26 to the housing 4 so that the vibrations at the handle 12 are diminished.

A motorized vibratory mechanism 42 is secured to the drive support structure 38 on the platform 26. The vibratory mechanism may consist of an electric motor with an eccentric weight mounted on the motor shaft, or the vibratory mechanism may be a piezzo mechanism or other suitable vibration generator. The vibratory mechanism 42 is operably connected to the electronic circuit 14 and through the circuit 14 to the battery 16. The vibratory mechanism 42 is capable of generating vibrations in a frequency of about 80 Hz to 250 Hz when power is supplied from the battery 16. The vibratory mechanism 42 is secured to the drive support structure 38 such as to cause the platform to vibrate in the frequency described above. A switch 44 on the electronic circuit 14 is selectively operable to provide power to the vibratory mechanism 42 from the battery 16.

The housing, damper and head support platform are assembled such that the housing is water-proof. After the battery, switch, electronic circuit and vibratory motor are installed in the housing, the housing shell components, damper and head support are assembled and secured together in waterproof manner by sonic welding or gluing. Alternatively, the damper, housing and head support platform may be bi-injection molded to form a waterproof unit.

The powered skin care device 2 has an oval, or egg-shaped, skin care head 46, alternatively referred to herein as a brush head, with a base 48 having a first side 50 with a face 52. A second side 54 (FIGS. 5, 6 and 7) of the base 48 is adapted to be selectively securable to the head support platform 26. The face 52 is adapted for contacting and cleansing skin. The head has a plurality bristles 55 provided in tufts 56. Each tuft 56 is secured to the first side 50 of the base 48 in tuft holes 62 by press fitting, stapling or adhering. Free ends 58 of the bristles define the face 52. In the embodiment shown, part of the face 52 lies in a plane illustrated by axis 60 that is parallel to the plane illustrated by axis 22 in which the opening 18 lies. However, it will be understood the face 52 may lie in any desired plane, or may be angled, or curved convexly or concavely relative to the plane illustrated by axis 60.

In the embodiment shown, the face 52 comprises at least two portions (FIGS. 3 and 4). A first portion 64 lies in the first plane illustrated by axis 60 that is parallel to the plane illustrated by axis 22 in which the opening 18 lies, i.e., parallel to the first side 50 of the base 48, and a second portion 68 lying in a second plane illustrated by axis 66 and forming an obtuse angle with the first portion (see FIG. 3).

The brush head thus has a first plane that is defined by bristles in the first portion 64 being of equal length, and the bristles in the second portion 68 (illustrated by shading of the tufts) decreasing incrementally in length over a distance to define the obtuse angle of the second plane illustrated by axis 66. The bristles of the first portion 64 are softer due to their longer length. The bristles of the second portion exhibit increasing stiffness as the bristle length decreases toward the tip of the brush. The longer, softer bristles of the first portion 64 are ideal for cleansing more sensitive skin, such as, for example, on the cheeks or forehead of a user. The shorter, stiffer bristles of the second portion 68 are better suited for more aggressive cleansing of oily, less sensitive skin, such as, for example, adjacent the nose or the crow's feet area adjacent the eyes.

The bristles in the tufts 56 are made of nylon or other suitable synthetic or natural material, such as, for example, polyamide, PBT, polyester, natural fibers, or other suitable material. Nylon is preferred for relatively more gentle cleansing and polyester is preferred for relatively more aggressive cleansing. The bristles may be made of anti-bacterial materials, or be provided with anti-bacterial ingredients, properties or coatings.

The bristles have a length measured from the first side 50 of the base 48 to the free ends 58 in the range of 3 mm to 30 mm. For gentle cleansing, the bristles of the first portion 64 preferably have a length of about 12 mm, and the bristles of the second portion 68 preferably have a length of about 12 mm decreasing to 9 mm. For more aggressive cleansing, as in an acne cleansing regimen, the bristles of the first portion 64 preferably have a length of about 9 mm and the bristles of the second portion 68 have a length decreasing incrementally from 9 mm to 6 mm. The bristles have a diameter in the range of 0.01 mm to 1.0 mm, but for gentle cleansing the bristles preferably have a diameter in the range of about 0.075 mm to 0.125 mm. For more aggressive cleansing, the bristles preferably have a diameter in the range of about 0,075 mm to 0.1 mm.

Alternatively, or in addition to varying the length of the bristles, the brush head may be with different zones of bristles having "stiffness differentiation", i.e., each zone will have bristles with a different stiffness from the other zone. By providing different stiffness zones in the brush, the brush will be better able to cleanse different skin types or different skin areas. A first plurality of bristles is provided in tufts 56 secured to the first side 50 of the base 48 in a first bristle zone corresponding to the first portion 64 of the face 52. A second plurality of bristles is provided in tufts 56 secured to the first side 50 of the base 48 in a second bristle zone corresponding to the second portion 68 (illustrated by shading of the tufts) of the face 52. At least some of said first plurality of bristles have a first stiffness and at least some of said second plurality of bristles having a second stiffness greater than the first stiffness to define a stiffness differential between the first portion 64 and second portion 68. To achieve the stiffness differential, the first plurality of bristles may have a first length that is longer than a length of the second plurality of bristles, as described above. The shorter length bristles would yield a greater stiffness than the longer bristles. Alternatively, the first plurality of bristles may have a first diameter that is smaller than the diameter of at least some of the second plurality of bristles. The greater diameter of the second plurality of bristles would yield the stiffness differential between the first portion and the second portion. Alternatively, the bristles may be provided in different materials in the first and second portions of the face. For example, the first portion could be natural bristles while the second portion is nylon or polyester. Or the first portion could be TPE while the second portion is nylon. As another alternative, the stiffness differential is provided by a difference in at least one of length, diameter and material between at least some of the first plurality of bristles and the at least some of the second plurality of bristles.

As an example, a first embodiment of the brush head adapted for gentle cleansing has nylon bristles in the first portion 64 of the face 52 with a length of 12 mm and a diameter of 0.075 mm. The second portion 68 of the face 52 has nylon bristles with a length decreasing incrementally from 12 mm to 9 mm and a diameter of 0.125 mm.

A second embodiment intended for more aggressive cleansing has polyester bristles (PBT) in the first portion 64 of the face 52 with a length of 9 mm and a diameter of 0.075 mm, and polyester bristles in the second portion 68 of the face 52 with a length decreasing incrementally from 9 mm to 6 mm.

The outer bearing surface 28 of the head support platform 26 may include a rim 70 with at least one slot 72 and at least one notch 74. The second side 54 of the brush head is adapted to be secured to the outer bearing surface 28 of the head support platform 26. At least one elastic arm 76 depends from the second side 54 of the brush head. The arm 76 terminates in a hook 78. The hook 78 is dimensioned and adapted to be received in the slot 72 to selectively retain the head on the platform 26. A lug 80 (FIGS. 5, 6 and 7) depends from the second side 54 of the base 48 of the brush head. The lug 80 is dimensioned and adapted to be received in the notch 74 in the bearing surface 28 of the head support platform 26. The lug 80 being received in the notch 74 acts to orient the brush head with the head support platform 26 such that the long dimension of the oval head is aligned along the longitudinal axis 10 of the housing 4, i.e., in the preferred orientation with respect to the handle for the user's convenience.

The housing and head support platform are preferably made of injection molded plastic materials such as, for example, ABS or PP. The damper is made of a resilient elastomeric material such as, for example, TPE, or other natural or synthetic rubber or silicone. TPE also serves as a so called 'soft touch' material that may be provided in the handle area and on the switch to improve touch and grip for the user (not shown).

The advantages of the invention are readily apparent. The powered skin care device is provided with a vibration damper between the head support platform 26 (that also carries the vibratory mechanism 42) and the handle 12 of the device to minimize transmission of the vibrations from the vibratory mechanism to the handle of the device. In addition, the damper minimizes noise from the vibratory mechanism, thus further improving the user experience. Additionally, the operating frequency of the vibrating motor has been selected to provide vibrations in a relatively gentle frequency and the brush head is provided with relatively soft bristles to further provide the user with a gentle but effective skin cleansing experience.

It is understood that various modifications and changes in the specific form and construction of the various parts can be made without departing from the scope of the following claims.

What is claimed is:

1. A powered skin care device comprising:

a housing with a hollow proximal end and a dosed distal end, a longitudinal axis defined from the proximal end to the distal end, the distal end forming a handle, the housing enclosing an electronic circuit connected to a battery, the proximal end defining an opening oriented at an oblique angle with respect to the longitudinal axis, the opening defining an inwardly directed annular surface;

a head support platform defining an outer bearing surface and an inner surface;

a skirt depending from the inner surface of the platform, the skirt defining an outwardly directed annular surface dimensioned to be received in spaced relation within the opening of the proximal end of the housing, the skirt further defining a cavity;

at least one drive support structure located on the skirt or on the inner surface of the platform within the cavity;

a vibration damper in the form of a resilient collar made from an elastically compliant material, the damper connecting the inwardly directed annular surface of the housing to the outwardly directed annular surface of the platform to resiliently secure the skirt in the opening of the hollow proximal end of the housing such that the outer bearing surface of the platform is positioned outside of the opening;

a motorized vibratory mechanism secured to the at least one drive support structure and operably connected to the electronic circuit and the battery, the mechanism capable of generating vibrations in a frequency of about 80 Hz to 250 Hz when power is supplied from the battery, the vibratory mechanism secured to the drive structure such as to cause the platform to vibrate;

a switch in the electronic circuit operable to selectively provide power to the vibratory mechanism from the battery;

a skin care head with a base having a first side supporting a face and a second side adapted to be selectively securable to the head support platform, the face adapted for contacting and cleansing skin; and a first plurality of bristles provided in tufts secured to the first side of the base in a first bristle zone and a second plurality of bristles provided in tufts secured to the first side of the base in a second bristle zone, at least some of said first plurality of bristles having a first stiffness and at least some of said second plurality of bristles having a second stiffness greater than the first stiffness to define a stiffness differential between the first bristle zone and second bristle zone.

2. The powered skin care device of claim 1 wherein the at least some of the first plurality of bristles has a first length and the at least some of the second plurality of bristles has a second length shorter than the first length to yield the stiffness differential.

3. The powered skin care device of claim 2 wherein the at least some of the first plurality of bristles has a length in the range of 9 mm to 12 mm, and the at least some of the second plurality of bristles has a length in the range of 6 mm to 9 mm.

4. The powered skin care device of claim 1 wherein the at least some of the first plurality of bristles has a first diameter and the at least some of the second plurality of bristles has a second diameter greater than the first diameter to yield the stiffness differential.

5. The powered skin care device of claim 4 wherein the at least some of the first plurality of bristles have a diameter of about 0.75 mm, and the at least some of the second plurality of bristles have a diameter in the range of 0.10 mm to 0125 mm.

6. The powered skin care device of claim 1 wherein the stiffness differential is provided by a difference in at least one of length, diameter and material between the at least some of the first plurality of bristles and the at least some of the second plurality of bristles.

* * * * *